US007159636B2

(12) United States Patent
Liang

(10) Patent No.: US 7,159,636 B2
(45) Date of Patent: Jan. 9, 2007

(54) SLAT CONTROL MECHANISM FOR VENETIAN BLINDS

(76) Inventor: Wen Ying Liang, No.276,Min Tsu Rd., Lu Kang Chen, Changhua Hsien (TW)

( * ) Notice: Subject to any disclaimer, the term of this patent is extended or adjusted under 35 U.S.C. 154(b) by 120 days.

(21) Appl. No.: 10/958,354

(22) Filed: Oct. 6, 2004

(65) Prior Publication Data

US 2006/0021716 A1 Feb. 2, 2006

(30) Foreign Application Priority Data

Jul. 30, 2004 (TW) ..... 93212122 U

(51) Int. Cl.
*E06B 9/303* (2006.01)

(52) U.S. Cl. ..... 160/115; 160/170; 160/173 R

(58) Field of Classification Search ..... 160/115, 160/173 R, 168.1 R, 170, 171, 176.1 R
See application file for complete search history.

(56) References Cited

U.S. PATENT DOCUMENTS 4,088,171 A * 5/1978 Schluep et al. ..... 160/170
4,522,244 A * 6/1985 Brolin ..... 160/170
5,628,356 A * 5/1997 Marocco ..... 160/170
6,330,899 B1 * 12/2001 Ciuca et al. ..... 160/170
6,516,856 B1 * 2/2003 Lai ..... 160/89
6,648,048 B1 * 11/2003 Lai ..... 160/115

* cited by examiner

*Primary Examiner*—David Purol
(74) *Attorney, Agent, or Firm*—Troxell Law Office, PLLC

(57) ABSTRACT

A slat control mechanism for Venetian blinds includes a control assembly, guide sliding assemblies, a linkage drawing plate, and abutting members wherein first rope ladders are suspended between upper and lower beams of a Venetian blind for the abutting position of a plurality of slats in an equal space thereto and are located to adjusting seats with adjusting rods attached thereto so as to tilt the slats into different angles thereby. A lift cord is sequentially led through each slat thereof and wound through a pulley seat adapted at one end of the upper beam to extend downwards there-from so as to lift or expand the slats thereby. The guide sliding assembly made up of a positioning seat and a guide sliding member is adapted at both corresponding sides of the two adjusting seats thereof respectively for retaining a second rope ladder thereby, and the control assembly made up of a fixing mount, a control member, and a retaining member is mounted at the other side of one adjusting seat thereof for locating an operational cord thereby in opposite to the lift cord of the pulley seat thereof. The second rope ladder, bestriding the bottommost slat in a U-shaped form, has a plurality of positioning steps to hold in place alternatively every even/odd slats thereby. Therefore, the operational cord is simply pulled to actuate the linkage drawing plate and synchronically move the control member and the guide sliding members connected therewith so as to draw upwards the second rope ladders in a linkage mechanism, facilitating an easier and effortless operation of the present invention to achieve the best using condition thereof.

6 Claims, 7 Drawing Sheets

SLAT CONTROL MECHANISM FOR VENETIAN BLINDS

BACKGROUND OF THE INVENTION

The present invention is related to a slat control mechanism for Venetian blinds, including a control assembly, guide sliding assemblies, a linkage drawing plate, and abutting members wherein first rope ladders are suspended between upper and lower beams of a Venetian blind for the abutting position of a plurality of slats in an equal space thereto, and a lift cord is sequentially led through each slat thereof and wound through a pulley seat adapted at one end of the upper beam to extend downwards there-from. The guide sliding assembly is adapted at both corresponding sides of two adjusting seats of the upper beam respectively for retaining a second rope ladder thereby, and the control assembly is mounted at the other side of one adjusting seat thereof for locating an operational cord in opposite to the lift cord of the pulley seat thereof; whereby, the operational cord is simply pulled to actuate the linkage drawing plate and synchronically move a control member of the control assembly and guide sliding members of the guide sliding assemblies connected therewith so as to draw upwards the second rope ladders in a linkage mechanism, facilitating an easier and effortless operation of the present invention to achieve the best using condition thereof.

Please refer to FIG. 1. A conventional blind slat control mechanism is made up of a Venetian blind 10 having a first rope ladder 11 and a second rope ladder 12 sequentially mounted to a plurality of slats 13 and respectively bestriding a lower beam 14 into U-shaped forms. Positioning slide posts 151 and a first and second pulley seats 152, 153 are respectively disposed at both ends of an upper beam 15 for both ends of the first and second rope ladders to wind there-through and extend downwards there-from. In practical use, the first rope ladder 11 is pulled downwards to draw up the odd-numbered or even-numbered slats 13, piling up the slats 13 in pairs to augment the light-passable space as shown in FIG. 2. When the second rope ladder 12 is pulled downwards, the slats 13 will keep gathering up from bottom to top in a sequence. A mounting seat with an adjustment member is adapted inside the upper beam 15 for retaining another rope ladder (without shown in the diagram) to tilt the slats 13 into different angles.

There are some drawbacks to such conventional blind slat control mechanism. First, the first and the second rope ladders 11, 12 are suspended downwards from the same side of the upper beam 15. In practical use, it's easy to confuse the two rope ladders 11, 12 and require a repetition of the operation thereof. Besides, in case pulling force is unevenly applied onto both ends of the first or the second rope ladders 11, 12, the slats 13 can easily get tilted and cause the inconvenience in operation thereof. Second, the first rope ladder 11 is wound through the lower beam 14 thereof. In case of a great pulling force applied thereto, the first rope ladder 11 tends to raise upwards the lower beam 14 and sequentially gather up each slat 13 from bottom to top, losing the function to pile up the slats 13 in pairs, and resulting in the difficult of control in operation thereof. Third, the first rope ladder 11, winding through the inner side of the lower beam 14, must first actuate the lower beam 14 before extending through the first pulley seat 152 to suspend downwards there-from, which can waste quite a lot of efforts and pains in the operation thereof.

SUMMARY OF THE PRESENT INVENTION

It is, therefore, the primary purpose of the present invention to provide a slat control mechanism for Venetian blinds, including a control assembly, guide sliding assemblies, a linkage drawing plate, and abutting members wherein the guide sliding assembly is adapted at both corresponding sides of two adjusting seats of an upper beam respectively for retaining a second rope ladder thereby, and the control assembly is mounted at the other side of one adjusting seat thereof for locating an operational cord thereby in opposite to a lift cord retained at the other side of the upper beam thereof; whereby, the operational cord is simply pulled to actuate the linkage drawing plate and synchronically move a control member of the control assembly and guide sliding members of the guide sliding assemblies connected therewith so as to draw upwards the second rope ladders in a linkage mechanism without the risk of tilting slats of a Venetian blind due to uneven pulling force applied thereto or of confusing both operational and lift cords in operation to achieve the best using condition thereof.

It is, therefore, the second purpose of the present invention to provide a slat control mechanism for Venetian blinds wherein the operational cord is simply pulled to actuate the linkage drawing plate and synchronically move each guide sliding member thereof so as to draw upwards the second rope ladder and neatly pile up the slats in pairs therewith, facilitating an easier and effortless operation of the present invention thereof.

DETAILED DESCRIPTION OF THE PREFERRED EMBODIMENTS

Figure 1:
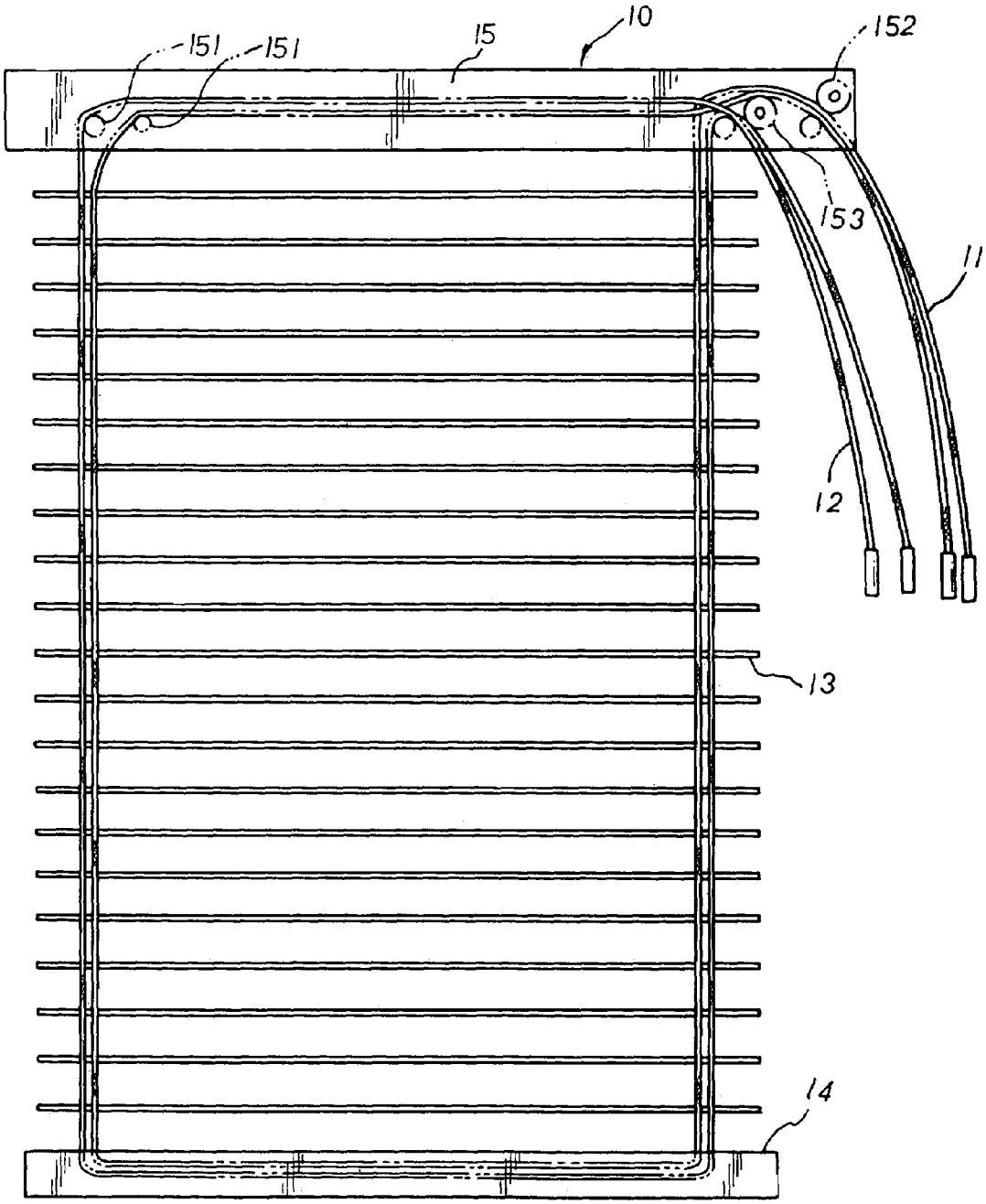
FIG. 1 PRIOR ART
FIG. 1 is a sectional view of a conventional blind slat control mechanism.
Figure 2:
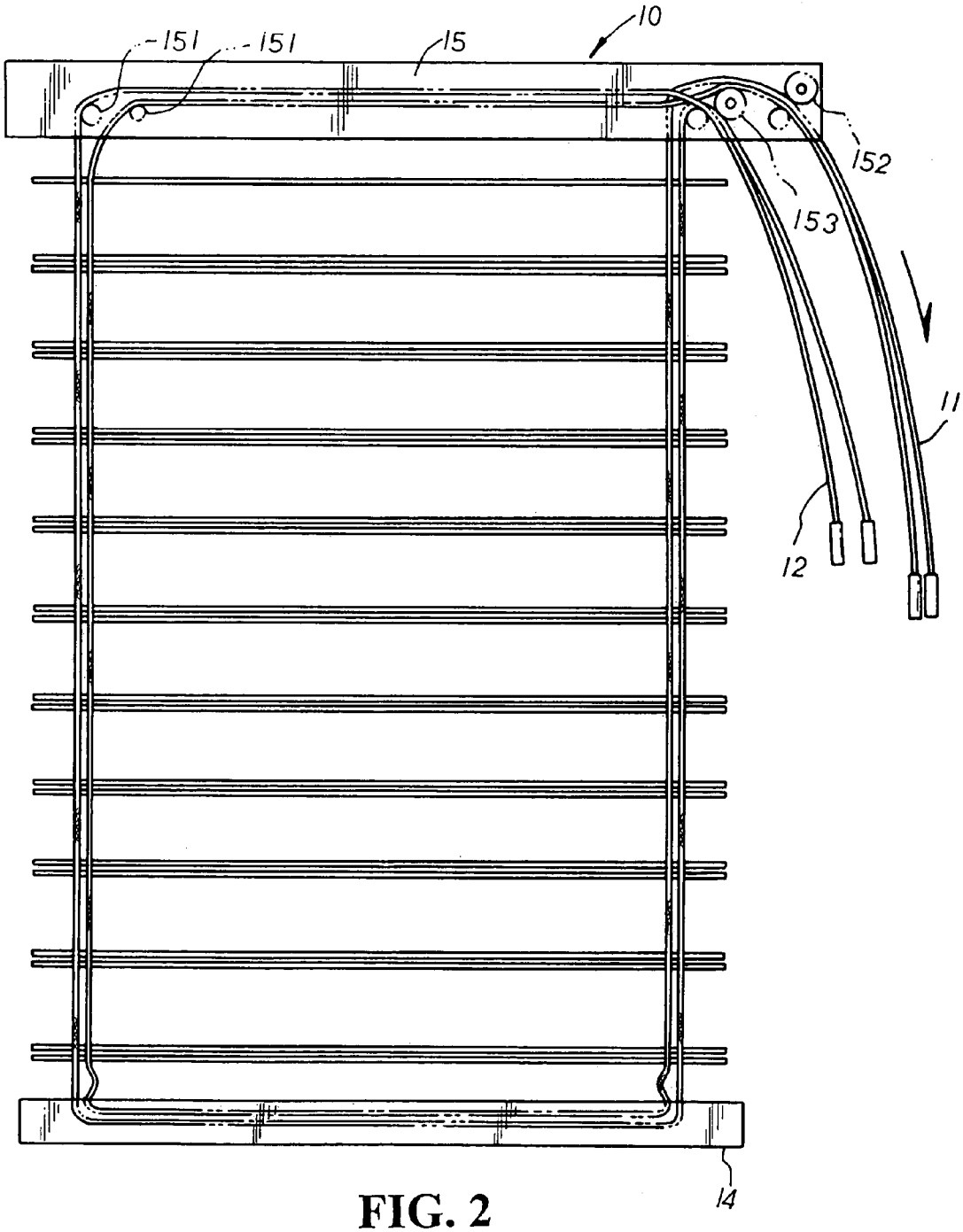
FIG. 2 PRIOR ART
FIG. 2 is a diagram showing the conventional blind slat control mechanism in practical use.
Figure 3:
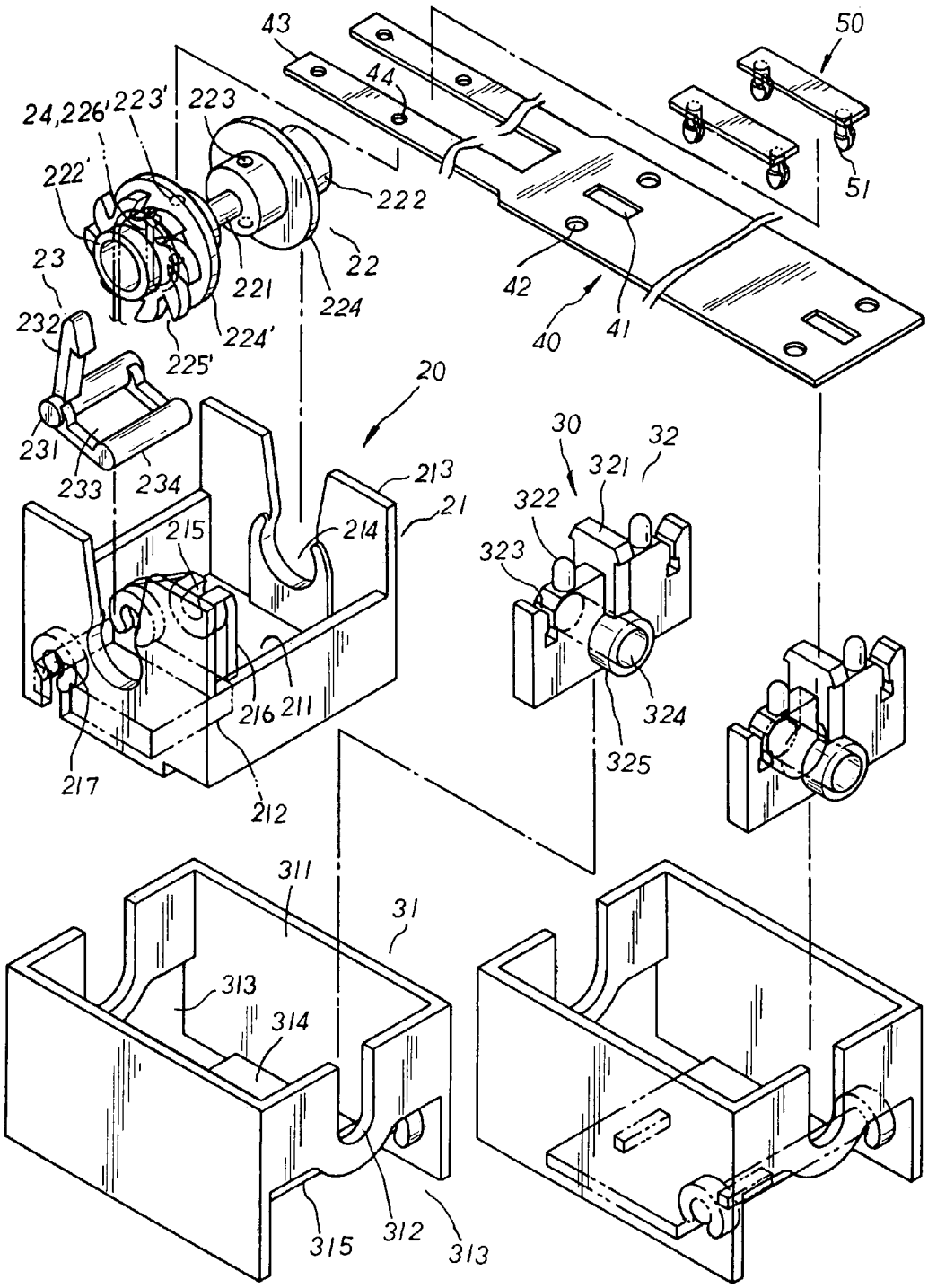
FIG. 3 is a perspective exploded view of the present invention.

Please refer to FIG. 3. The present invention is related to a slat control mechanism for Venetian blinds, including a control assembly 20, guide sliding assemblies 30, a linkage drawing plate 40, and abutting members 50. The control assembly 20 is made up of a fixing mount 21, a control member 22, and a retaining member 23 wherein the fixing mount 21 has a base board 211 with a through hole 212 defined at one side thereon, two sidewalls 213 extending at both sides of the base board 211 thereon, an opening slide groove 214 concaved downwards at the upper edge of each sidewall 213 thereof, and a reinforcing support plate 216 with an upper edge defined by a pivoting groove 215 protruding upwards in the middle of the base board 211 thereon. The pivoting groove 215 of the reinforcing support plate 216 and the slide grooves 214 of the sidewalls 213 thereof are provided for retaining a linkage rotational shaft 221 and a pair of roller ends 222, 222' of the control member 22 respectively thereby. A pair of C-shaped engaging slots 217 with lower opening defined thereon is symmetrically disposed at preset positions of the reinforcing support plate 216 and one sidewall 213 thereon, precisely locating above both sides of the through hole 212 thereon for an annular pivoting rod 231 of the retaining member 23 to mount thereto. At one side of the roller ends 222, 222' is respectively disposed an engaging thru-hole 223, 223' communicating the upper and lower peripheries of the roller ends 222, 222' thereby, and at the corresponding side of both thru-holes 223, 223' thereof is respectively disposed a limiting stop ring 224, 224' of a larger diameter. At the other side of the roller end 222' is annularly disposed a protrusive and toothed adjusting area 25' with a pull cord thru-hole 226' disposed between the toothed adjusting area 225' and the limiting stop ring 224' thereof for an operational cord 24 to be led there-through and wound around the roller end 222' thereby. The retaining member 23 is also equipped with a retaining hook 232 extending upwards at one side of the pivoting rod 231 thereof in matched working with the toothed adjusting area 225' thereof, and an actuation section 234 with a rectangular cord-passage hole 233 defined thereon tilting downwards in a proper angle at the other wise of the pivoting rod 231 and located precisely at the through hole 212 of the fixing mount 21 therein. Thus, the operational cord 24 can be simultaneously led through the cord-passage hole 233 and the through hole 212 thereof to extend downwards there-from.

The guide sliding assembly 30 is made up of a positioning seat 31 and a guide sliding member 32 wherein the positioning seat 31 is defined by a limiting cavity 311 with an upper opening disposed at the inner side thereof. The limiting cavity 311 thereof has a pair of locating slots 312 symmetrically concaved at both lateral sidewalls thereon, a pair of right-angle recesses 313 symmetrically cut at both sides of the bottom thereon to provide a guide board 314 at the bottom thereby, and a guide shaft 315 pivotally mounted at one side of the guide board 314 thereof. The guide sliding member 32 is equipped with an inserting block 321 with hooks defined thereon protruding upwards in the middle section thereof, a pair of protrusive coupling posts 322 with indented retaining grooves 323 symmetrically disposed at both sides of the inserting block 321 thereof, and a pivoting tube 325 with an inner guide thru-hole 324 defined therein symmetrically extending right beneath the inserting block 321 in vertical alignment therewith. The linkage drawing plate 40 is made of a flexible plate body having an inserting slot 41 and two inserting holes 42 aligned side by side at preset positions of the upper surface thereon to mate precisely with the inserting block 321 and the coupling posts 322 of the guide sliding member 32 thereof respectively. At one side of the linkage drawing plate 40 is also disposed a pair of extension ends 43 each having a plurality of locking thru-holes 44 defined thereon to mate precisely with elastic engaging legs 51 of the abutting member 50 thereof.

Figure 4:
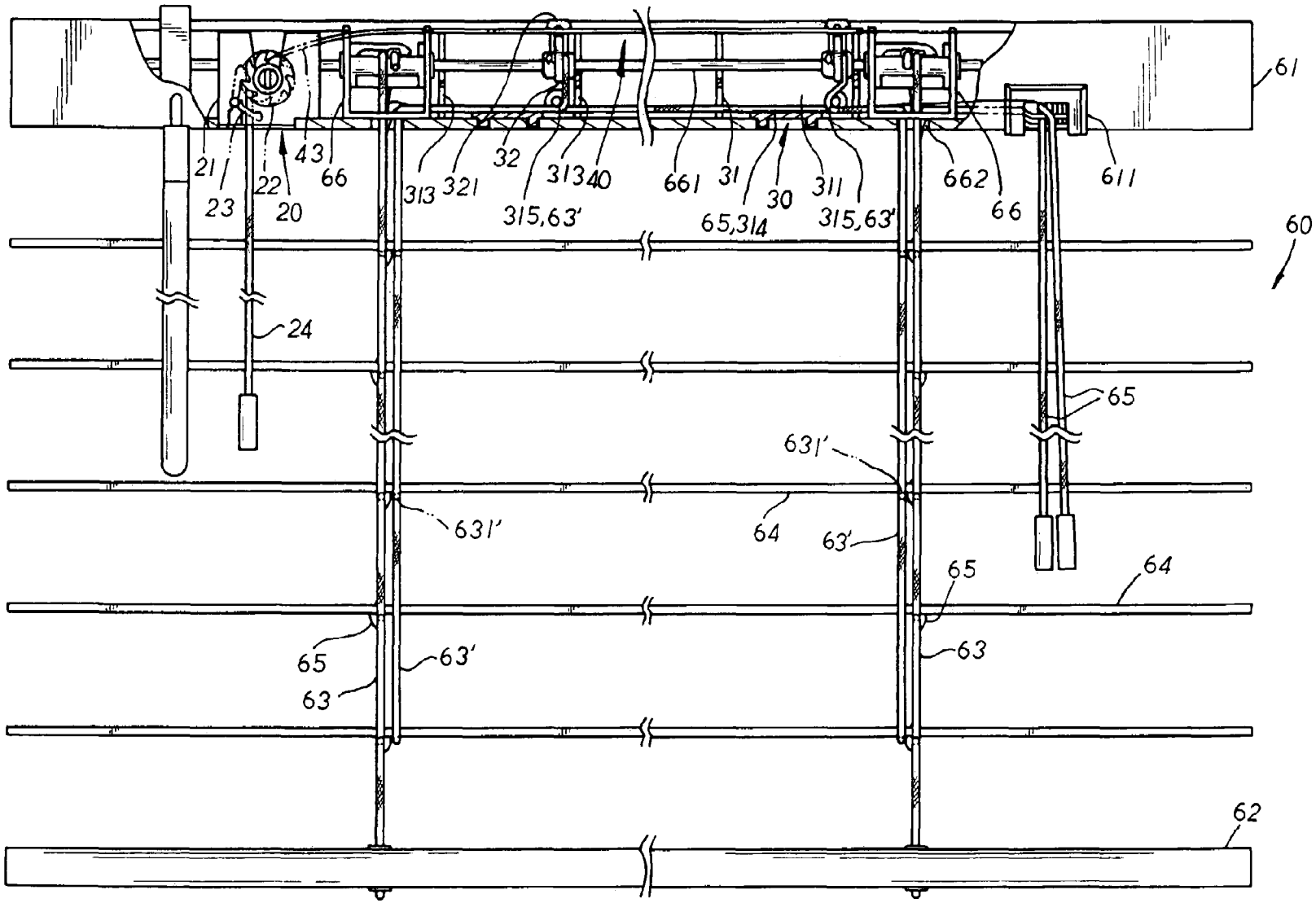
FIG. 4 is a cross sectional view of the present invention in assembly.
Figure 5:
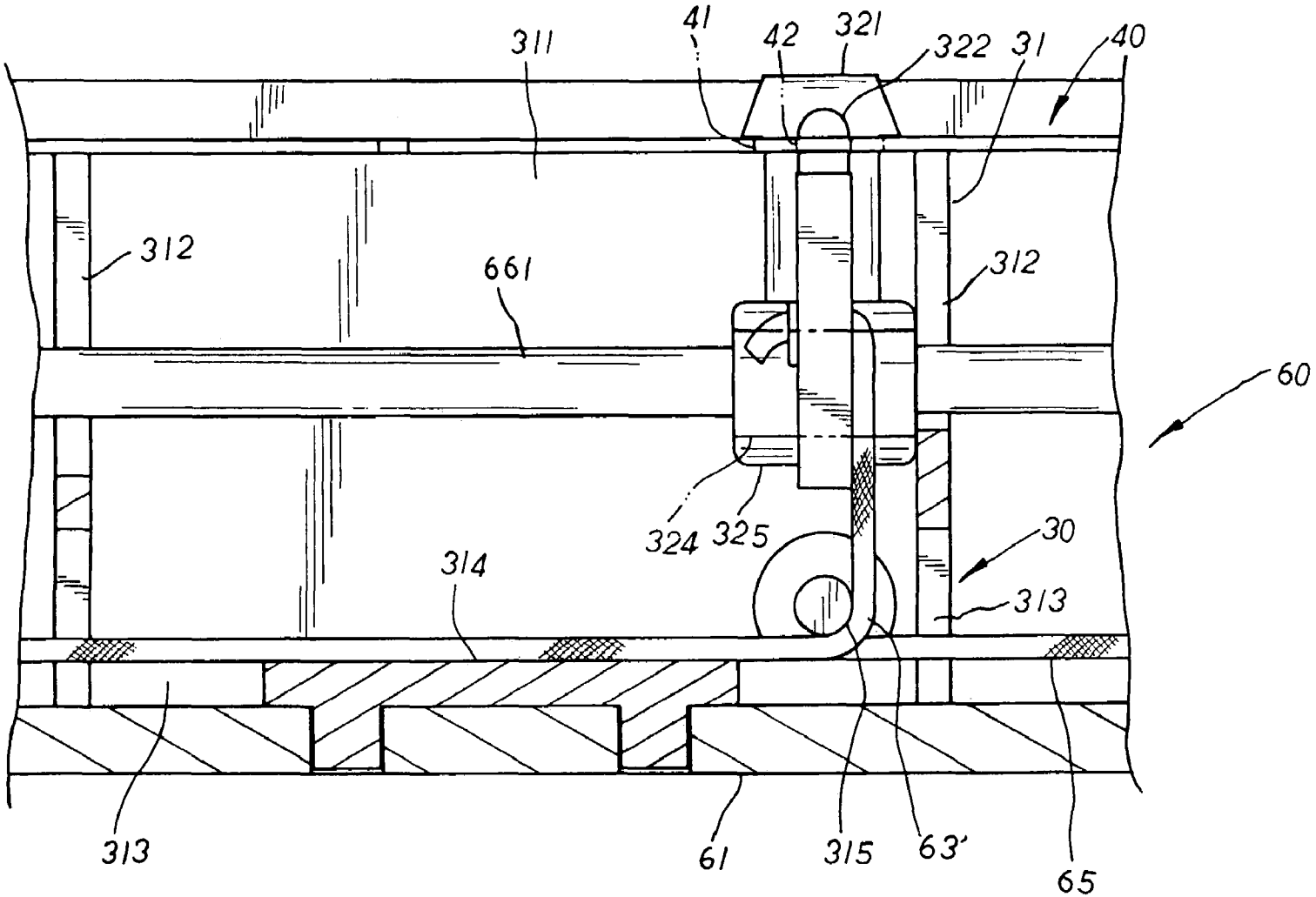
FIG. 5 is a partially enlarged and cross sectional view of the present invention in assembly.
Figure 6:
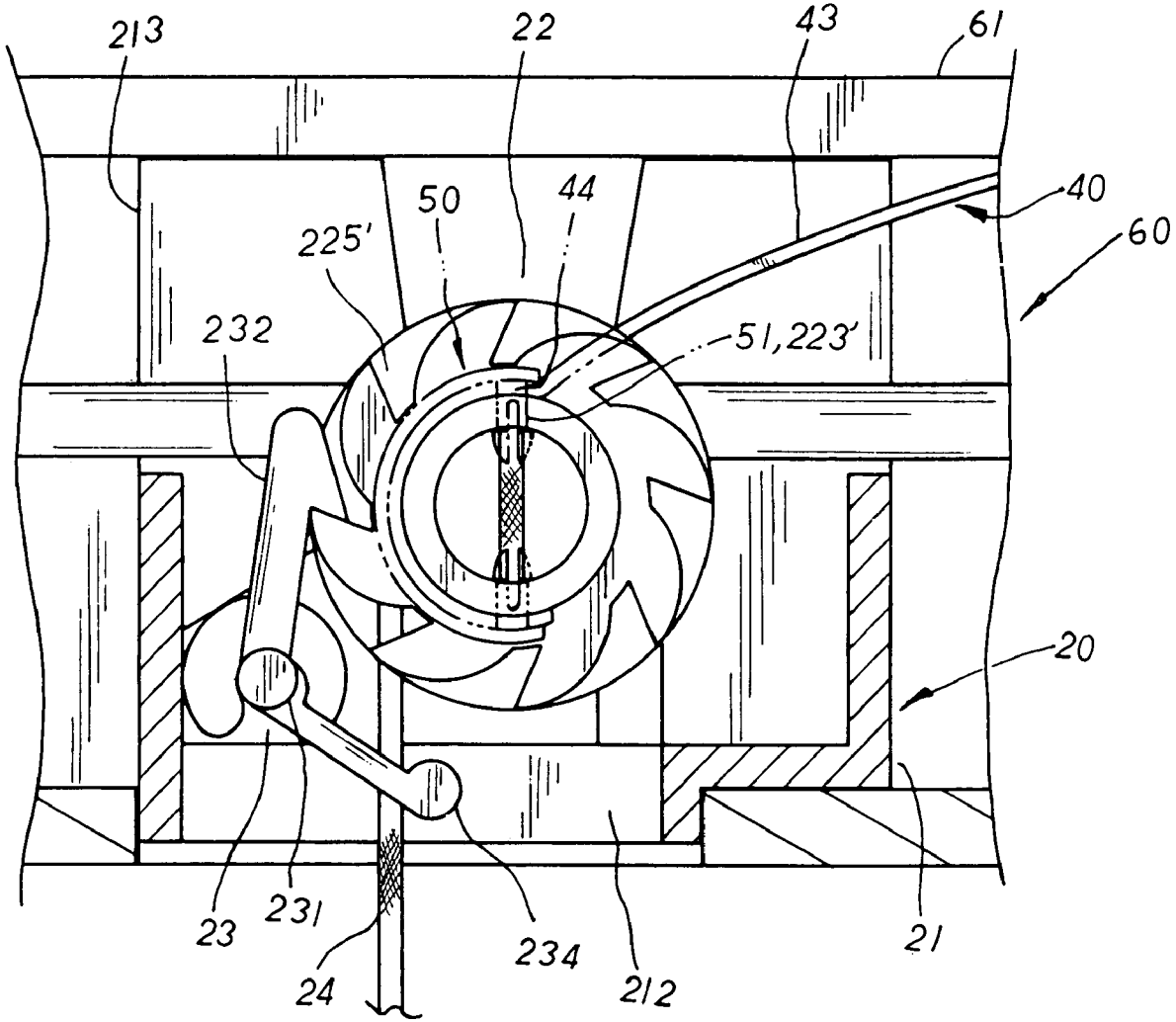
FIG. 6 is an enlarged and cross sectional view of a control assembly engaged with a linkage drawing plate of the present invention.

Please refer to FIGS. 4 to 6 inclusive. In assembly as shown in FIG. 4, first rope ladders 63 are suspended between upper beam 61 and lower beam 62 of a Venetian blind 60 for the abutting position of a plurality of slats 64 in an equal space thereto. A lift cord 65, sequentially led through each slat 64 thereof and fixedly attached to the lower beam 62 at the bottom end thereof, is wound through a pulley seat 611 adapted at one end of the upper beam 61 therein to extend downwards there-from. The upper ends of each first rope ladder 63 are wound and fixed to an adjusting seat 66 that, having an adjusting rod 661 attached thereto, is respectively accommodated at both inner sides of the upper beam 62 thereof so as to tilt the slats 64 into any angle thereby. One guide sliding assembly 30 is respectively adapted at both corresponding sides of the two adjusting seats 66 thereof, permitting the lift cord 65 extending at the outermost side of the pulley seat 611 thereof to sequentially pass through the recesses 313 of the positioning seat 31 and extend along the guide board 314 thereof till reaching the adjusting seat 66 to wind around the pulley seat 611 and suspend downwards there-from. Then, the pivoting tube 325 of the guide sliding member 32 is placed into the locating groove 312 disposed at one side of the limiting cavity 311 thereof, permitting the adjusting rod 661 thereof to pivotally lead through the guide thru-hole 324 of each guide sliding member 32 thereof. At the corresponding sides of each first rope ladder 63 is mounted a second rope ladder 63' suspended downwards in a U-shaped form to bestride the bottommost slat 64 thereof and provided with a plurality of positioning steps 631' to hold in place alternatively every even/odd slats 64 thereby. Both ends of the second rope ladder 63' are respectively led upwards through a rope passage hole 662 of the adjusting seat 66 thereof and extended through the recess 313 of the adjacent positioning seat 31 thereof to come into the limiting cavity 311 before winding through the guide rod 315 till securely fixed at the retaining grooves 323 thereof as shown in FIG. 5. The fixing mount 21 of the control assembly 20 is securely located at the other end of the upper beam 61 correspondingly in opposite to the pulley seat 611 thereof and precisely adjacent to one of the adjusting seats 66 thereof. Then, the inserting slot 41 and the inserting holes 42 of the linkage drawing plate 40 are mounted form top to bottom to correspondingly engage with the inserting block 321 and the coupling posts 322 of the guide sliding member 32 respectively, permitting the linkage drawing plate 40 to precisely abut on top of the positioning seat 31 thereof. The two extension ends 43 of the linkage drawing plate 40 are respectively guided to wind around the roller ends 222, 222' of the control member 22 thereof till the locking thru-holes 44 thereof are correspondingly mated with the engaging thru-hole 223, 223' thereof respectively. Then, the abutting members 50 are curved into an arch to wind around the coiled up extension ends 43 thereof, and the elastic engaging legs 51 thereof are respectively forced into the locking thru-holes 44 and the engaging thru-holes 223, 223' thereof so as to securely attach the extension ends 43 of the linkage drawing plate 40 to the two roller ends 222, 222' of the control member 22 respectively thereby. Meanwhile, the operational cord 24 is wound around the roller end 222' defined by the limiting stop ring 224' and the toothed adjusting area 225' thereof and suspends downwards there-from for a certain length at one side of the upper beam 61 thereof. And the actuation section 234 of the retaining member 23, accommodating at the through hole 212 of the fixing mount 21 there in and influenced by the force of gravity, will actuate the pivoting rod 231 to rotate downwards along the engaging slots 217 thereof, permitting the retaining hook 232 to precisely abut against the toothed adjusting area 225' of the control member 22 and located thereby as shown in Fig. 6., completing the assembly of the present invention thereof. And upon the pulling or release of the lift cord 65 thereof, the slats 64 are easily collected or expended in an effortless operation thereof.

Figure 7:
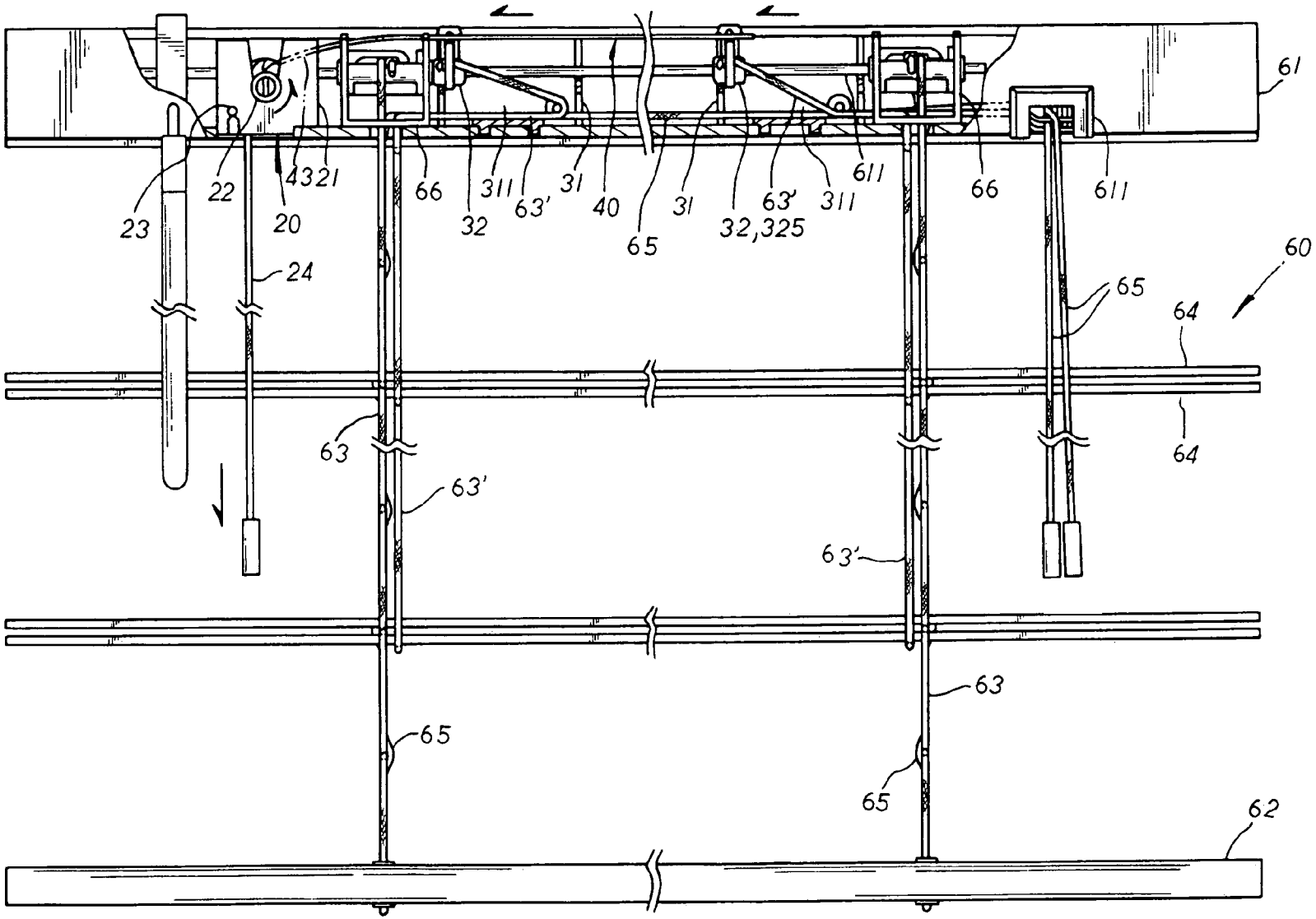
FIG. 7 is a diagram showing the operation of the present invention in practical use.

Please refer to FIG. 7. To increase the light-passable space of the slats 64 thereof, the operational cord 24 is pulled downwards to actuate the two roller ends 222, 222' and the linkage rotational shaft 221 of the control member 22 respectively rotating along the slide grooves 214 and the pivoting groove 215 thereof in the same direction accordingly. The toothed adjusting area 225' thereof is simultaneously rotated along with the actuated control member 22 therewith, pushing aside the retaining hook 232 of the retaining member 23 so as to detach from the abutting location of the retaining hook 232 thereof. Thus, the control member 22 can be freely rotated to release the operational cord 24 wound around the roller end 222' thereof, and the extension ends 43 of the linkage drawing plate 40, affected by the force of the ongoing rotation of the control member 22, are respectively wound around and collected at the two roller ends 222, 222' thereof. Meanwhile, the guide thru-hole 324 of each guide sliding member 32 is synchronically slid along the adjusting rod 661 and moved towards the other side of the limiting cavity 311 of the positioning seat 31 thereof, actuating the second rope ladder 63' fixed at the retaining grooves 323 therein to withdraw upwards along with the sliding movement of the guide sliding member 32 thereof. And the even/odd slats 64 abutting against the positioning steps 631' of the second rope ladder 63' thereof are sequentially lifted upwards accordingly to pile up with the adjacent slats disposed above respectively. Then, the operational cord 24 is released, permitting the retaining hook 232 of the retaining member 23 to re-abut against the toothed adjusting area 225' for mutual engagement thereof so as to precisely relocate the second rope ladders 63' at the lift position thereof. Thus, the slats 64 of the Venetian blind 60 can be sequentially piled up in pairs with the light-passable space accurately increased so as to adjust the light coming indoors and achieve the purpose of light control. Via the guide sliding members 32 with the second rope ladders 63' and the linkage drawing plate 40 connected thereto in a linkage mechanism, the operational cord 24 is simply pulled to actuate the guide sliding members 32 and synchronically lift upwards the second rope ladders 63' therewith, efficiently refraining from the risk of tilting the slats 64 due to uneven pulling force applied thereto in operation to achieve the best using condition thereof.

To expand the Venetian blind 60 downwards again, the operational cord 24 is pulled to one side at the cord-passage hole 233 of the retaining member 23 therein till pushing against the actuation section 234 to rotate upwards and tilting the retaining hook 232 to one side therewith so as to detach the retaining hook 232 from the adjusting area 225' of the control member 22 thereof. When the operational cord 40 remains drawn sideways to push against the actuation section 234 thereof, the pulling force thereof is properly released, permitting the second rope ladders 63' affected by the gravity of the slats 64 to generate a down-pulling force thereby. And the extension ends 43 of the linkage drawing plate 40 wound around the control member 22 thereof and pulled by the gravity force of the descending slats 64 thereof will actuate the rotation of the control member 22 therewith, permitting the guide sliding members 32 thereof to move back to the original positions thereof with the second rope ladders 63' synchronically released downwards accordingly so as to expand the slats 64 again thereby. Then, the operational cord 24 is rewound around the roller end 222' along with the rotation of the control member 24 and recollected thereon. Finally, and the operational cord 24 is simply released to re-abut the retaining hook 232 of the retaining member 23 against the adjusting area 225' for relocation thereof.

What is claimed is:

1. A slat control mechanism for Venetian blinds, including a control assembly, guide sliding assemblies, a linkage drawing plate, and abutting members wherein first rope ladders are suspended between upper and lower beams of a Venetian blind for an abutting position of a plurality of slats each having an adjusting rod attached thereto, are adapted at both inner sides of the upper beam so as to tilt the slats into different angles thereby; a lift cord, threaded through each slat and fixedly attached to the lower beam at the bottom end thereof, the lift card being threaded through a pulley seat adapted at one end of the upper beam and extends downwards there-from so as to lift or expand the slats, wherein:

the guide sliding assembly including a positioning seat and a guide sliding member being adapted at both corresponding sides of two adjusting seats thereof respectively;

the control assembly including a fixing mount, a control member, and a retaining member being mounted at the other side of one adjusting seat thereof and actuated by an operational cord wound around a roller end of the control assembly opposite to the lift cord of the pulley seat;

the linkage drawing plate being respectively connected with the guide sliding members of the guide sliding assemblies thereof and the control member;

a second rope ladder, wound and fixed to each guide sliding member thereof, being suspended downwards to run the length of the bottommost slat, the second rope ladder being provided with a plurality of positioning steps to hold in place alternatively every other slat;

wherein in operation the slat control mechanism is configured so that via the operational cord, the control member of the control assembly and the guide sliding members of the guide sliding assemblies as well as the linkage drawing plate and the second rope ladders thereof are synchronically actuated.

2. The slat mechanism for Venetian blinds as claimed in claim 1 wherein the positioning seat of the guide sliding assembly has a limiting cavity with an upper opening defining the inner side thereof, and the limiting cavity thereof has a pair of locating slots at both lateral sidewalls thereon, a pair of right-angle recesses at both sides of the bottom surface thereof to provide a guide board at the bottom thereby; a guide shaft is pivotally mounted at one side of the guide board thereof.

3. The slat control mechanism for Venetian blinds as claimed in claim 1 wherein the guide sliding member of the guide sliding assembly includes an inserting block with hooks defined thereon protruding upwards in a middle section thereof, a pair of protrusive coupling posts with indented retaining grooves symmetrically disposed at both sides of the inserting block thereof, and a pivoting tube with an inner guide thru-hole vertically extending beneath the inserting block.

4. The slat control mechanism for Venetian blinds as claimed in claim 1 wherein the linkage drawing plate is made of a flexible plate body.

5. The slat control mechanism for Venetian blinds as claimed in claim 1 wherein the linkage drawing plate further comprises an inserting slot and two inserting holes on the upper surface of the linkage drawing plate to engage both an inserting block and the coupling posts of the guide sliding member and at one side of the linkage drawing plate is a pair of extension ends each having a plurality of locking thru-holes defined thereon to engage with elastic engaging legs of one of the abutting member.

6. The slat control mechanism for Venetian blinds as claimed in claim 1 wherein the fixing mount of the control assembly has a base board with a through hole defined at one side, two sidewalls extending at both sides of the base board thereon, an opening slide groove at the upper edge defined by a pivoting groove protruding upwards in a middle section of the base board thereon, wherein the pivoting groove of the reinforcing support plate and the slide grooves of the sidewalls thereof are configured for retaining a linkage rotational shaft and a pair of roller ends of the control member; the slat control mechanism further comprising:

a pair of C-shaped engaging slots with lower openings defined thereon on the reinforcing support plate and one sidewall thereon, the C-shaped engaging slots being located above both sides of the through hole thereon for an annular pivoting rod of the retaining member to mount thereto;

at one side of the roller ends is respectively disposed an engaging thru-hole and at another side of both engaging thru-holes thereof is respectively disposed a limiting stop ring; at another side of one roller end a protrusive and toothed adjusting area with a pull cord thru-hole are disposed between the adjusting area and the limiting stop ring thereof for an operational cord to be led there-through and wound around the roller end; the retaining member further including a retaining hook extending upwards at one side of the pivoting rod thereof in a position to engage the toothed adjusting area thereof, and an actuation section with a rectangular cord-passage hole defined thereon tilting downwards at the other side of the pivoting rod.

* * * * *